United States Patent [19]

Finn

[11] 4,384,507

[45] May 24, 1983

[54] ADJUSTABLE SOUND SUPPRESSOR FOR WEAPON

[76] Inventor: Charles A. Finn, 2808 Todd, Oceanside, Calif. 92054

[21] Appl. No.: 175,364

[22] Filed: Aug. 6, 1980

[51] Int. Cl.[3] ..... F41C 21/18

[52] U.S. Cl. ..... 89/14 D; 181/241

[58] Field of Search ..... 42/79; 89/14 B, 14 C, 89/14 D; 181/223, 241, 271

[56] References Cited

U.S. PATENT DOCUMENTS

| | | | |
|---|---|---|---|
| 1,127,250 | 2/1915 | Humm | 89/14 D |
| 1,187,581 | 6/1916 | Weil | 181/241 |
| 1,354,416 | 9/1920 | Oliver | 89/14 D |
| 1,482,805 | 2/1924 | Maxim | 89/14 D |
| 3,164,060 | 1/1965 | Dahl | 89/14 D |
| 3,776,093 | 12/1973 | Leverance et al. | 89/14 D |
| 3,786,895 | 1/1974 | Perrine | 89/14 D |

FOREIGN PATENT DOCUMENTS

| | | | |
|---|---|---|---|
| 684938 | 7/1930 | France | 89/14 D |

*Primary Examiner*—Stephen C. Bentley

[57] ABSTRACT

A sleeve is slidable longitudinally of a can, on a weapon, containing sound suppressing means, between a first position retracted onto the can and a second position extending forwardly from the can with only adjacent ends lapping, to enhance sound suppressing action when the sleeve is moved to the second extended position. A longitudinally extending slot in the sleeve, with laterally extending notches, and a stop disposed in the slot to limit movement of the sleeve on the can. A knob with lock means to secure the stop in a selected notch of the slot.

3 Claims, 5 Drawing Figures

10
14
30
40
42
46
84
86
88
80
82
82
24
20
26
58
32
54
56
50
56
64
72
60
70
62
52
12
22
28
26

20
54
58
60
62
56
56
68
70
66
64

ADJUSTABLE SOUND SUPPRESSOR FOR WEAPON

BRIEF SUMMARY OF THE INVENTION, BACKGROUND AND OBJECTIVES

My invention was the subject of Disclosure Document 089,000, dated Mar. 13, 1980.

My invention relates to means to increase sound suppression in a sound suppressor when desired by increasing its length and to reduce the length of the suppressor on the weapon when desired by retraction.

One desirable feature in a suppressor is to maximize sound suppression and another is to minimize bulk or length of the suppressor for easier handling. It is an objective of my invention to achieve both features by means to change the length of the suppressor. Further objectives include providing a structure of simple, safe and reliable action, to devise means for operation even in the dark, to provide means to lock the structure in selected position, and to devise a low cost device and one requiring minimum maintenance.

A preliminary examination search was conducted on the invention and the searcher cited the patents identified below:

U.S. Pat. No. 1,354,416
U.S. Pat. No. 3,164,060
U.S. Pat. No. 3,786,895
U.S. Pat. No. 1,482,805
U.S. Pat. No. 3,776,093
No. 684,938-French I was not familiar before with the specific devices shown in these patents. I do not believe these patents, or anything else before me, has the structure claimed below as my invention.

My invention will be best understood, together with additional objectives and advantages thereof, from the following description, read with reference to the accompanying drawings.

DRAWINGS

DESCRIPTION

Figure 1:
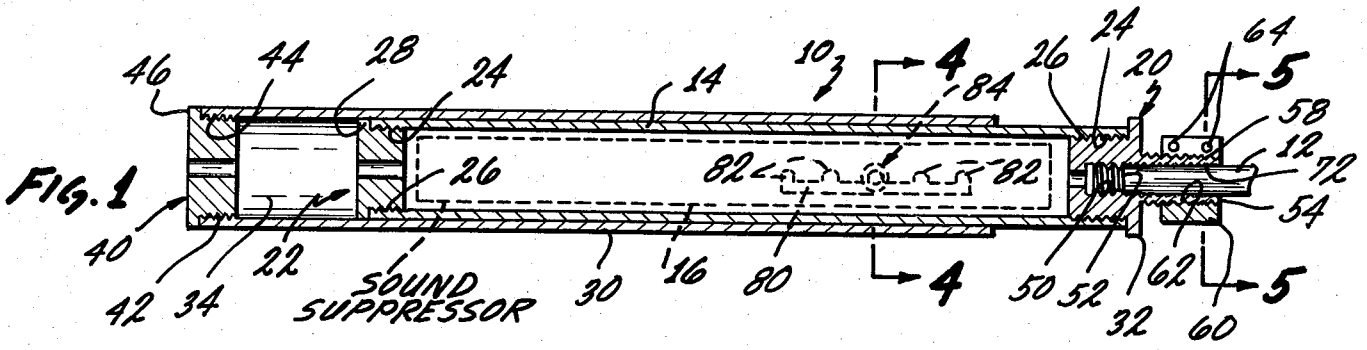
FIG. 1 is a longitudinal view, partly in section, of a specific embodiment of my new adjustable sound suppressor for a weapon.
Figure 2:
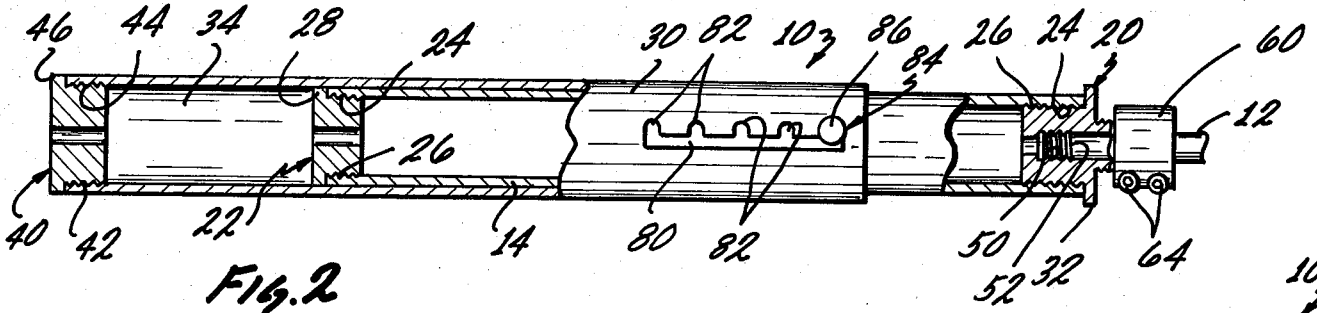
FIG. 2 is another longitudinal view, partly in section.
Figure 4:
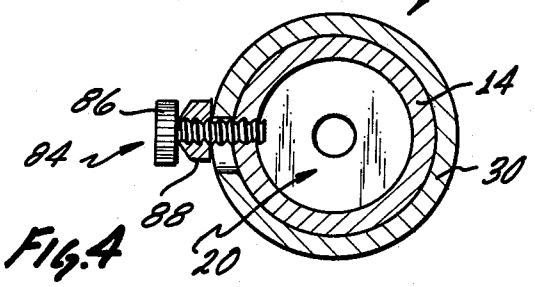
FIG. 4 is a view, partly in section, taken on line 4—4 of FIG. 1.
Figures 3, 5:
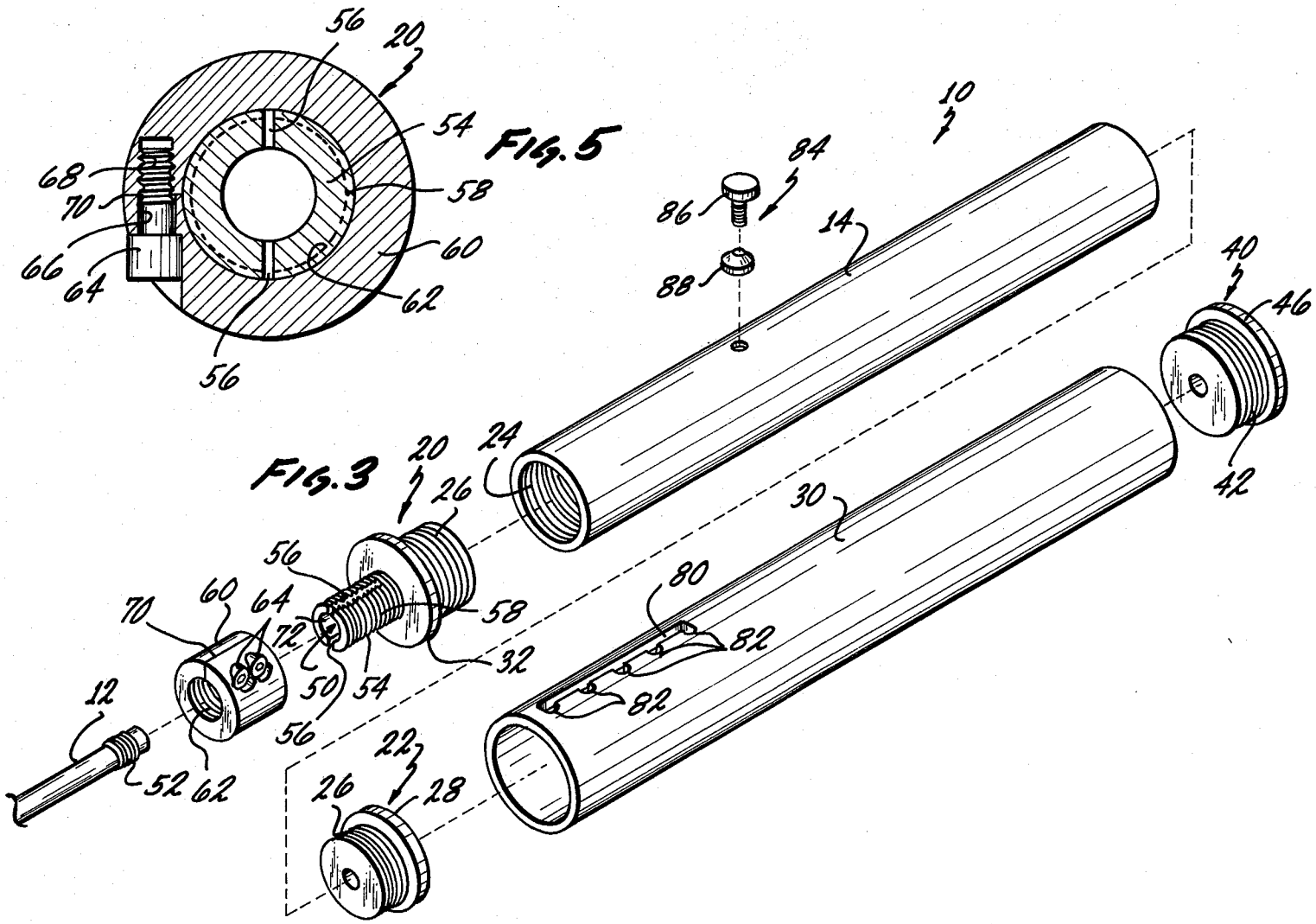
FIG. 3 is an exploded perspective view.
FIG. 5 is a view, partly in section, taken on line 5—5 of FIG. 1.

My concepts, etc., of an adjustable sound suppressor can be summarized in part as follows:

1. Provide a telescoping sleeve on a sound suppressor can that may be extended to provide an expansion chamber forward of the can. The forward chamber can accommodate the precursor wave, i.e., the compressed air volume in front of a projectile. Depending on the speed of the projectile relative to the speed of sound, this can be a shock wave. In other words, the compressed air may expand or displace to the side thereby permitting the projectile to exit before the precursor wave, instead of the precursor wave having to exit from the sound suppressor before the projectile. By exiting after the projectile, the wave or volume of compressed air may exit over a longer duration of time and therefore exit at a considerably lower sound level.
2. When the sleeve is extended, a large secondary expansion chamber is provided in the sleeve forward of the end of the can. The extra chamber allows for further expansion of gases, in addition to the expansion of gases that occur in the can. In this way, gases not only expand more before exiting from the suppressor but also the gases escape over a longer duration of time and produce a lower sound level.
3. The sleeve concept, by its collapsible nature and its efficiency, makes it possible to reduce the overall size of a sound suppressor, i.e., for a given amount of sound suppression, the collapsed suppressor will have less length or volume than the normal non-collapsible suppressor.
4. The sleeve concept lends itself to basically every known suppressor type.
5. Preliminary tests of a prototype have shown 68% greater sound suppression by adding the sleeve to the can of an existing type of sound suppressor.

It should be understood that the preceding discussion of the operation of compressed air, etc., involved in the addition of an extended sleeve to a sound suppressor, as shown and described, is theoretical. The important thing is the results obtained, which are not theoretical, whether or not the technical explanation of operation is correct or complete. As far as is known, the 68% improvement is representative of what can be achieved with my invention, whether or not my description of why or how it works is completely accurate technically or scientifically. When sleeves of various lengths, etc., are added to other suppressors, possibly greater or less sound reductions will be achieved, but I have demonstrated that results can be quite significant.

I will now specifically describe the suppressor 10 shown in the drawings, which is added to a weapon 12 symbolized by its barrel. A sound suppressor can 14 has sound suppressing mean 16 indicated by a general block. The sound suppressing means 16 can be of any conventional or suitable type which will commonly involve baffles.

Can 14 has a bored projectile entrance plug 20 and a bored projectile exit plug 22 shown as threadedly secured in place by threads 24 on the interior of the can and by threads 26 on the exterior of the plugs. The flange 28 on exit plug 22 should be small enough to fit within sleeve 30, whereas the flange 32 on entrance plug 24 may be of sufficient diameter to lap the ends of sleeve 30 when the sleeve is retracted although other stop means for the retraction of sleeve 30 are provided.

Sleeve 30 is slidably mounted on can 14 and is movable between a first fully retracted position and a second fully extended position with only the adjacent ends of sleeve and can lapping. It will be observed that when sleeve 30 is fully extended it forms another secondary sound suppressing expansion chamber 34 in addition to the chamber of can 14. The chamber 34 is closed by a bored projectile exit plug 40 secured in place by threads 42 on plug 40 and by threads 44 on the inside of sleeve 30. Plug 40 has a flange 46.

The sound suppressing action of sleeve chamber 34 presumably has something to do with providing expansion room for gas exiting with or ahead of a projectile. As above indicated, the correct analysis of the reason for its effectiveness is not necessarily known but its effectiveness has been measured at 68% increase in sound suppression in one model.

The sound suppressor 10 is suitably attached to the barrel 12 of a weapon. In the attaching structure shown, it is part of can entrance plug 20 and includes the threaded bore 50 of plug 20 which engages with threads 52 on barrel 12. To secure suppressor 10 from becoming unthreaded from barrel 12, the rear portion or boss 54 of plug 20 is diametrically split at 56. Boss 54 has external threads 58 and a split nut 60 with internal threads 62 engages threads 58. Set screws 64 extend through openings 66 and are threaded into openings 68 on opposite sides of the split 70 of nut 60, whereby screws 64 can be tightened to compress boss 54 on barrel 12 to lock plug 20 from becoming unthreaded from the barrel. Surface 72 inside boss 54 is not threaded but may be scored in the process of making threads 50 whereby surface 72 will have additional functional gripping on barrel 12.

Sleeve 30 has a longitudinal slot 80 and a series of notches 82 extending laterally therefrom. A stop 84 attached to can 14 extends into slot 80. When stop 84 is at one end of slot 80, sleeve 30 is fully extended, and when stop 84 is at the other end of slot 80, sleeve is fully retracted. Notches 82 represent other selected positions which, along with the extreme ends of slot 80, may be sensed tactilely without looking or even in the dark, so that positioning of sleeve 30 on can 14 does not depend on sight or on having time to look, but instead can be done rapidly by sense of feeling as the user gains experience with use of suppressor 10.

Stop 84 is a bolt screwed into can 14 and having a knurled head 86 and a locking washer 88. Thus, stop 84 can be secured in adjusted position in slot 80 or in one of the notches 82 by manually tightening the bolt by means of knurled head 86.

Having thus described my invention, I do not wish to be understood as limiting myself to the precise structure shown. Instead I wish to cover those modifications thereof which will occur to those skilled in the art upon learning of my invention and which properly fall within the scope of my invention.

I claim:

1. The improvement in a sound suppressor extending forwardly from the barrel of a weapon, comprising:

(a) said suppressor having a generally cylindrically shaped can having interior sound suppressing means, (b) a bored entrance end plug on said can and means securing said can to said barrel of said weapon, (c) a tubular sleeve fitted on said can and slidable longitudinally of said can between a first position retracted onto said can and a second position extending forwardly from said can with only adjacent ends lapping whereby the sound suppressing action of said suppressor is enhanced by lengthening thereof as said sleeve is moved from said first position toward said second position, (d) securing means securing said sleeve in selected position on said can, and (e) said securing means including a slot in said sleeve extending longitudinally of said suppressor and a stop extending from said can into said slot thereby limiting movement of said sleeve relative to said can.

2. The subject matter of claim 1 in which stop is a threaded body with a manually operable knob with lock means whereby said stop can be tightened to lock said sleeve in position on said can.

3. The subject matter of claim 2 in which said sleeve has a plurality of notches extending laterally from said slot in which said stop can be selectively positioned to index extension of said sleeve relative to said can and for locking of said stop in a selected position.

* * * * *